United States Patent [19]

Reinert et al.

[11] Patent Number: 4,505,470

[45] Date of Patent: Mar. 19, 1985

[54] DOCUMENT HANDLING MACHINE HAVING REMOTE ADJUSTMENT MECHANISM

[75] Inventors: Warren Reinert; George Fallos, both of Easton, Pa.

[73] Assignee: Bell & Howell Company, Phillipsburg, N.J.

[21] Appl. No.: 429,891

[22] Filed: Sep. 30, 1982

[51] Int. Cl.[3] ..... B65H 3/08

[52] U.S. Cl. ..... 271/100; 271/107; 271/171; 271/142

[58] Field of Search ..... 271/90, 99, 100, 101, 271/107, 171, 142; 226/137, 138, 139

[56] References Cited

U.S. PATENT DOCUMENTS

| | | | |
|---|---|---|---|
| 3,253,503 | 5/1966 | Hayden | 226/139 X |
| 3,804,402 | 4/1974 | Hottendorf | 271/144 X |
| 3,893,664 | 7/1975 | Thomsen | 271/100 |
| 4,358,101 | 11/1982 | Janecek | 271/171 X |
| 4,406,447 | 9/1983 | Fichte | 271/171 X |

*Primary Examiner*—Richard A. Schacher

*Attorney, Agent, or Firm*—Griffin, Branigan & Butler

[57] ABSTRACT

A document handling machine is provided with various embodiments of means for remotely adjusting the position of a feeding means (44) associated with a hopper (20). The machine is also provided with means for remotely adjusting the position of a plate (32) within the hopper (20).

14 Claims, 18 Drawing Figures

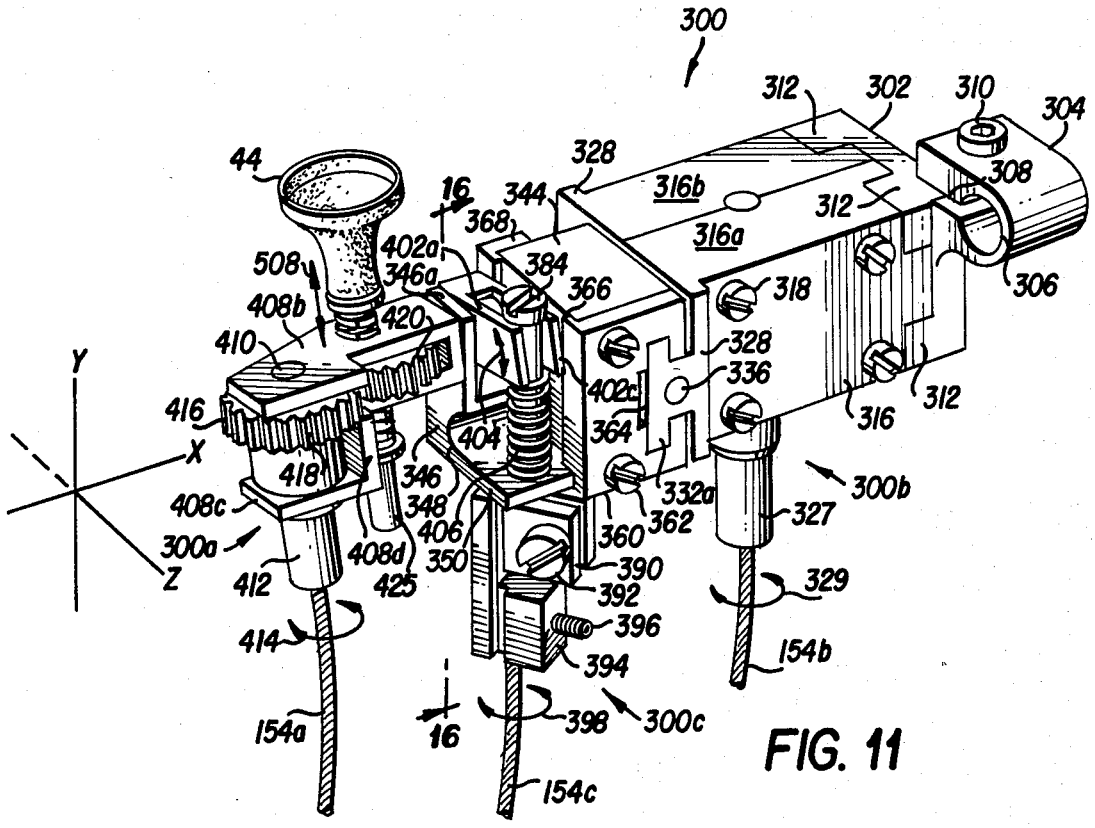
FIG. 11
FIG. 16
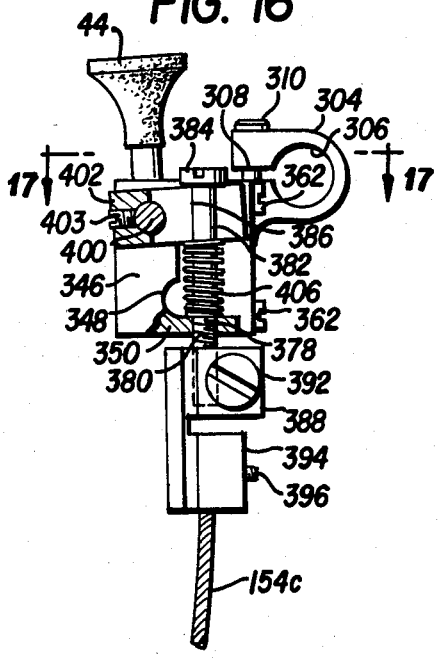
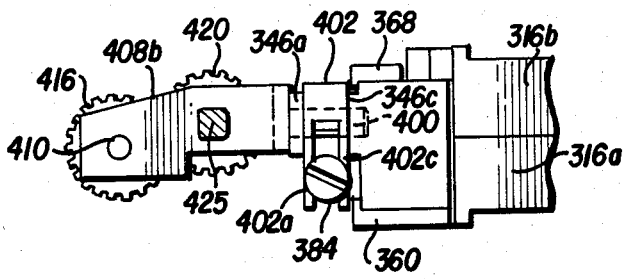
FIG. 13

DOCUMENT HANDLING MACHINE HAVING REMOTE ADJUSTMENT MECHANISM

BACKGROUND

This invention relates to document handling machines and more particularly to mechanical adjustments that can be made to such machines to change their set-up and adapt them for different sizes, shapes, and forms of documents that the machine will be required to handle.

Many current document handling machines such as inserting machines, for example, must be shut down to make adjustments to a sucker which pulls inserts from a hopper. A mechanic must estimate roughly what adjustments are to be made in an up-and-down position, an in-out position, and a tilt position of the sucker so that it will perform properly when a new set-up is required. After making the initial adjustments, the machine is turned on and samples of the inserts are passed through the machine to test the set-up position of the sucker to see if it is performing properly. This sequence is generally repeated many times before the mechanic finally adjusts the machine accurately enough so that it will perform satisfactorily. This results in a significant loss of machine time while these adjustments are being made and also requires a skilled mechanic to perform the adjustments. It is an object of this invention, therefore, to provide a means and method whereby adjustments can be made to suckers or other such devices while the document handling machine is in operation.

An advantage of a preferred embodiment of the invention about to be described is that the above-discussed adjustments can be accurately made by a machine operator who need not be a skilled mechanic.

The structure of the invention, therefore, provides an economic benefit of increased productivity over the current means where the machine is shut down to make adjustments; and, a savings because skilled mechanics are not required to make the necessary adjustments to the machine.

SUMMARY

A document handling machine is provided with various embodiments of means for remotely adjusting the position of a feeding means associated with a hopper. The adjusting means facilitate the remote adjustment of the position of the feeding means in an up-and-down, in-out, and tilt direction. The embodiments of adjusting means are responsive to the rotary motion of an elongated flexible connector to produce a required positional displacement of the feeding means. The adjustments can be made while the machine is in operation.

A document handling machine is also provided with means for remotely adjusting the position of a hopper plate upon which documents are supported. The adjusting means is responsive to the rotary motion of an elongated flexible connector and converts the rotary motion into essentially linear translation.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating principles of the invention.

FIG. 11 is a perspective view of another embodiment of adjusting means;

FIG. 13 is a sectional view of the adjusting means of FIG. 12 taken along the line 13—13;

FIG. 16 is a sectional view of the adjusting means of FIG. 11 taking along the line 16—16.

DETAILED DESCRIPTION OF THE DRAWINGS

Figure 1:
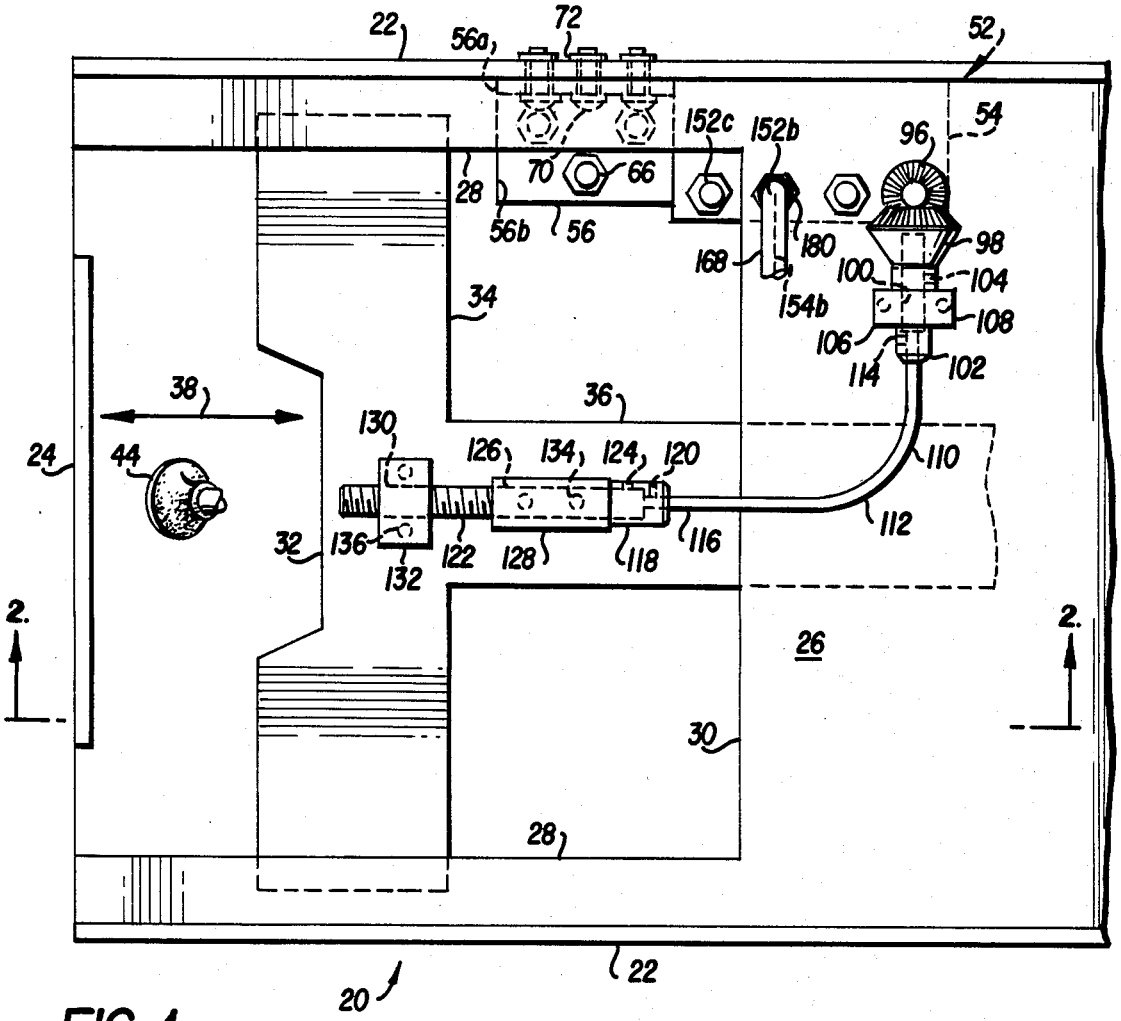
FIG. 1 is a bottom view of a hopper.
Figure 2:
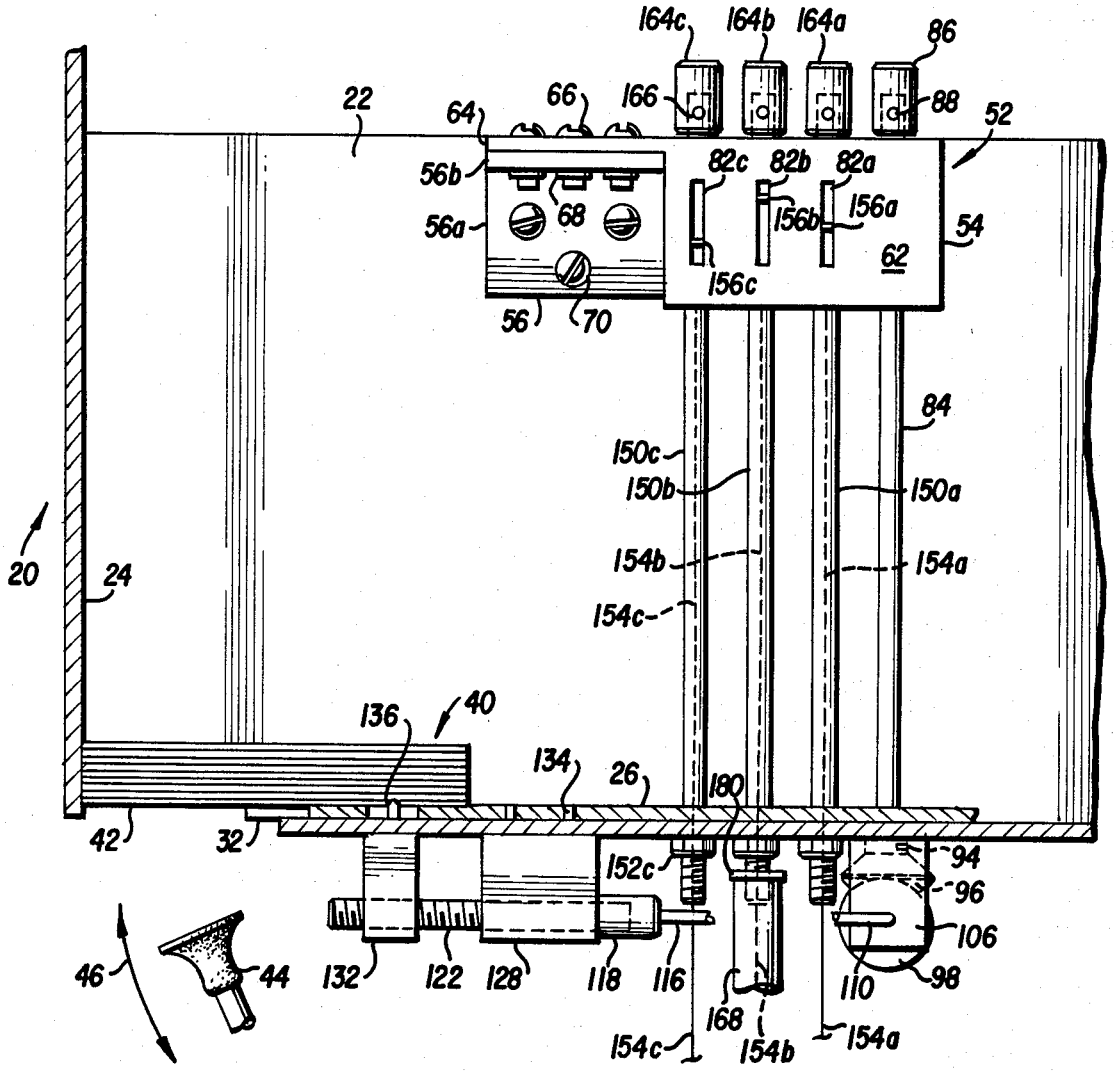
FIG. 2 is a sectional view of FIG. 1 taken along the line 2—2.

FIGS. 1 and 2 illustrate a hopper 20 of a document handling machine. The hopper 20 comprises two side walls 22, a front wall 24, and a floor 26. The floor 26, being essentially U-shaped as seen from above, comprises two side rails 28 and a rearward portion 30. A movable insert breaker plate 32, essentially T-shaped as seen from above, has a head portion 34 and an essentially perpendicular base portion 36 which travel on the side rails 28 and rearward portion 30 of floor 26, respectively. A gap (indicated in FIG. 2 as a double-headed arrow labeled 38) exists between the insert breaker plate 32 and the front wall 24 of the hopper 20. A stack of documents 40, such as inserts, for example, are arranged one upon another beginning with a lowermost document 42 which lies upon the insert breaker plate 32.

A feeding means, such as a sucker cup 44, is positioned below the floor 26 of the hopper 20 and proximate the gap 38 between the insert breaker plate 32 and front wall 24. In a manner similar to prior art structure (such as that illustrated in FIGS. 3 and 3A and labeled by primed reference numerals), the sucker cup 44 is generally adapted to rotate in the direction of arrow 46 about a machine actuating shaft 48. The sucker cup 44 is in communication with a source of vacuum (not illustrated) to enable it to selectively deflect the lowermost document 42 from the stack 40. Thereafter, extracting means 50 removes the lowermost sheet 42 and deposits it on a conveyor or the like (not shown). In the above regard it should be noted that, unlike the embodiments about to be described, the prior art apparatus of FIGS. 3 and 3A basically includes a rigid clamp 51' for connecting feeding means 44' to the machine actuating shaft 48'.

Figure 4:
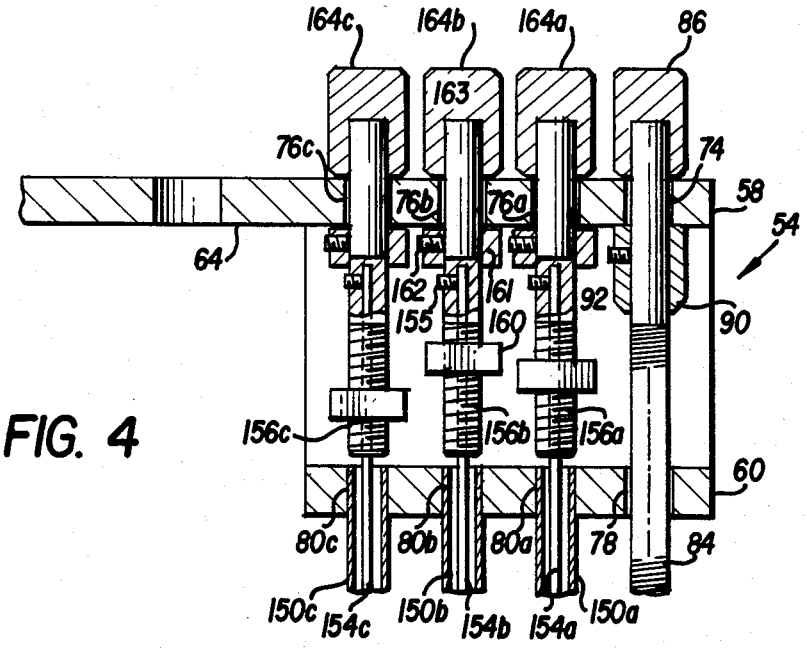
FIG. 4 is a isolated sectional view showing portions of a control panel housing.

A control panel 52 is mounted to the document handling machine near the top of one side wall 22. The control panel 52 comprises a control panel housing 54 and an L-shaped mounting bracket 56. The mounting bracket 56 has two arms **56*a* and 56*b*. As seen in FIG. 4, the control panel housing 54 comprises a top portion 58; a bottom portion 60; and at least one side wall 62 (FIG. 2). The top portion 58 includes a flange 64 which extends over arm 56*b* of the bracket 56. Three fasteners 66 extend through appropriately sized and aligned apertures in both flange 64 and arm 56*b* and are provided with a nut 68 thereon to secure the flange 64 to the mounting bracket 56**.

Mounting bracket 56 is secured to the side wall 22 by three fasteners 70 which extend through both mounting arm bracket **56*a* and side wall 22. Nuts 72 (FIG. 1) on the fasteners 70 secure the mounting bracket 56 to the side wall 22**.

The top 58 of control panel housing 54 has four openings 74, **76*a*, 76*b*, and 76*c* provided therein. Likewise, the bottom 60 of control panel housing 58 has correspondingly aligned openings 78, 80*a*, 80*b*, and 80*c*. A side wall 62 of control panel housing 54 has three slots 82*a*, 82*b*, and 82*c***, formed therein.

A top end of a gear shaft 84 extends through the aligned openings 78 and 74 of the control panel housing 54 and terminates in a socket portion of a gear shaft control knob 86. The shaft 84 is secured in control knob 86 by appropriate fastening means, such as set screw 88. A hollow collar 90 having an exterior diameter greater than the diameter of the opening 74 is mounted on the exterior of the shaft 84 just below the top 58 of housing 54 and is secured thereto by a set screw 92.

A bottom end of the gear shaft 84 extends through an opening in the hopper floor 26. The bottom end of the gear shaft 84 has secured thereto by a set screw 94 (or other appropriate fastening means) a toothed gear 96 of a miter gear combination. Gear 96 meshes with a second toothed gear 98 of the miter gear combination which is oriented essentially orthogonally with respect to gear 96.

In the above regard, gear 98, being essentially circular in cross-section, has a circular aperture in its center which accommodates a shaft portion 100 of a connector 102 (see FIGS. 1 and 2). The shaft portion 100 is secured in the gear 98 by a set screw 104 or other suitable fastening means. An intermediate portion of the shaft 100 of connector 102 protrudes through an appropriately sized aperture in a mounting block 106 which, in turn, is secured to the underside of hopper floor 26 by screws 108 (illustrated in FIG. 1 only). Although not illustrated as such, it should be understood that bearings or the like may be provided in the interior of block 106 around the periphery of shaft 100 to facilitate rotation of the connector 102.

A first end 110 of a flexible cable 112 is secured to a socket in the connector 102 by an appropriate fastener, such as set screw 114. A second end 116 of flexible cable 112 is secured within a socket in a first end of a connector 118 by a fastener 120. A second end of the connector 118 contains a socket adapted to engage a threaded adjusting screw 122. The adjusting screw 122 is secured to connector 118 by a fastener, such as a set screw 124.

The adjusting screw 122 passes through both a counter-threaded bore 126 in a screw block 128 and a counter-threaded bore 130 in a breaker plate block 132. Screw block 128 and breaker plate block 132, serving as carriage means, are secured to the underside of insertion breaker plate 32 by fasteners 134 and 136, respectively.

Turning again to FIGS. 2 and 4, three hollow metal shafts **150*a*, 150*b*, and 150*c* extend from below the floor 26 of hopper 20 and through the respective openings 80*a*, 80*b*, and 80*c* in control panel housing bottom 60. Each hollow shaft 150 is threaded at a bottom end thereof beneath floor 26 to receive a locking nut 152 which secures the hollow metal shaft 150 to the floor 26**.

Elongated flexible connecting means, such as flexible cables **154*a*, 154*b*, and 154*c*, extend through the hollow interior of the respective shafts 150*a*, 150*b*, and 150*c*, and continue beyond the end of the shafts 150 into the control panel housing 54. A top end of each flexible cable 154 is secured by a respective set screw 155 in a central internal channel of a cable end connector 156. In this respect, three end connectors 156*a*, 156*b*, and 156*c* are provided for respective flexible cables 154*a*, 154*b*, and 154*c*. A lower portion of each end connector 156 is externally threaded to receive thereon indicating means, such as an indicator nut 160. A shoulder portion 161 of each end connector 156 has a greater diameter than both the threaded portion of each end connector 156 or the corresponding opening 76 in housing top 58. A central socket in the shoulder portion 161 of each end connector 156 has secured therein by appropriate fastening means, such as set screws 162, an essentially cylindrical member 163 having a diameter less than the diameter of the openings 76 in housing top 58. Each cylindrical member 163 protrudes through a corresponding opening 76 with sufficient clearance to be rotatable therein. Each cylindrical member 163 extends into an interior socket of a corresponding control knob 164 and is secured therein by set screws 166. For reasons to become evident hereinafter, control knob 164*a* shall be referred to as an up-and-down adjustment control knob; 164*b* shall be referred to as an in-out adjustment control knob; and, 164*c*** shall be referred to as a tilt adjustment control knob.

From FIGS. 2 and 4, it should be evident that the end connectors 156 are essentially aligned with openings 76 and 80 in the control panel housing 54. In this respect, slots 82 are formed in the side wall 62 of housing 54 so that as seen from the side (FIG. 2) indicating nuts 160 are visible through the slots 82.

The flexible cables **154*a*, 154*b*, and 154*c* are protected by the respective hollow metal shafts 150*a*, 150*b*, and 150*c* as the cables extend from the control panel housing 54 to the floor 26 of the hopper 20. The flexible cables are shown as dashed lines inside the hollow metal shafts 150 of FIG. 2. Although each hollow metal shaft 150 terminates slightly below the floor 26 of hopper 20, the flexible cables continue on to connect to corresponding adjusting mechanisms described hereinafter. Although only one flexible cable (154*b*) is shown as such, each flexible cable is protected by a flexible sheath 168 as the flexible cable 154 continues to the adjusting mechanism. The flexible sheath 168 may be secured to the threaded end of the hollow metal shaft by any appropriate fastening means, including a clamp 180** or the like.

FIGS. 5 through 10 illustrate a combination of adjusting means 200 according to one embodiment of the invention. The adjusting means combination comprises adjusting means 200*a*, adjusting means 200*b*, and adjusting means 200*c*. Each adjusting means 200 comprises a cable end connector (202*a*, 202*b*, or 202*c*). Each connector 202 has a central socket at one end thereof for receiving an end of a corresponding flexible cable 154. In this respect, connector 202*a* receives flexible cable 154*a* (which is ultimately connected to up-and-down adjustment control knob 164*a*); connector 202*b* receives flexible cable 154*b* (which is ultimately connected to in-out adjustment control knob 164*b*); and, connector 202*c* receives flexible cable 154*c* (which is ultimately connected to tilt adjustment control knob 164*c*). Each flexible cable 154 is secured into its corresponding end connector 202 by appropriate fastening means, such as a set screw 204 (shown only with respect to end connector 202*a* in FIG. 10).

An end of each end connector 202 opposite the cable-receiving end thereof contains a central internal socket adapted to receive a first end of an essentially cylindrical extension shaft 206. Each extension shaft 206 is secured in end connector 202 by set screws 208 (shown only with respect to end connector 202*a* in FIG. 10). The extension shaft 206 extends from connector 202 through a corresponding circular thrust bearing 210 and then through appropriate mounting structure, such as mounting bars 212 or 214. Upon emerging from the mounting bars, an intermediate portion of each extension shaft 206 acquires an annular shoulder 216 of greater diameter than the remainder of the shaft 206.

Figure 10:
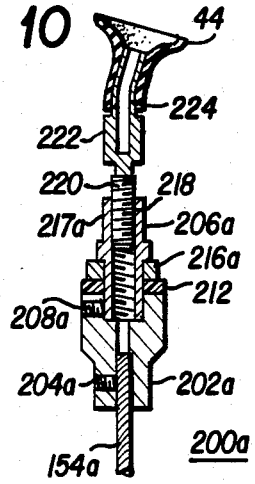
FIG. 10 is a sectional view of the adjusting means of FIG. 6 taken along the line 10—10.
Figure 8:
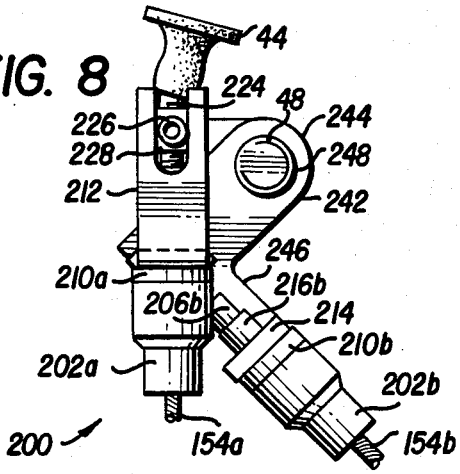
FIG. 8 is a right side view of the adjusting means of FIG. 5.
Figure 9:
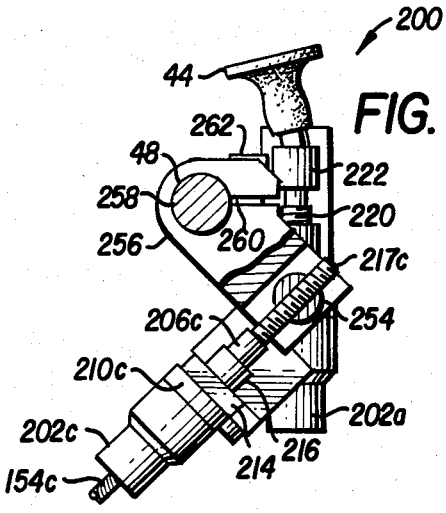
FIG. 9 is a left side view of the adjusting means of FIG. 5.

Beyond its annular shoulder 216 each extension shaft 206 resumes with a smaller diameter to its second end. As seen in FIG. 10, the second end of extension shaft 206*a* is centrally bored at 218 and internally counter-threaded to receive a threaded stem 220. The extension shafts 206*b* and 206*c*, on the other hand, have second end portions 217*b* and 217*c*, respectively, externally threaded to pass through appropriate pivot pins as hereinafter described.

In addition to the cable end connector 202*a* and extension shaft 206*a*, adjusting means 200*a* additionally comprises an essentially cylindrical sucker cup holder 222. The sucker cup holder 222 is mounted upon the threaded stem 220 which is adapted to be received in central bore 218 of extension shaft 206*a*. A hollow neck portion 224 connects the essentially hollow holder 222 to a vacuum cup, or sucker cup 44, fitted thereon. A peripheral opening on the sucker cup holder 222 opens into a hollow tubular connector 226 which is fitted with a flexible vacuum line (not illustrated).

In the above regard, the mounting bar 212 referenced earlier is actually L-shaped so that at one extreme the extension shaft 206*a* passes therethrough and at a second extreme orthogonal to the first a longitudinal slit 228 is formed. The tubular connector 226 extends transversely through the longitudinal slit 228 in the L-shaped mounting bar 212.

The mounting bar 212 is integral with an essentially cubical portion 230 of a block member 232. In this respect, the mounting bar 212 is oriented essentially diagonally with respect to one face 234 of the cube 232. A rotating pivot pin 236 extends through two opposite faces of the cube 230 and is internally counter-threaded to receive the threaded end portion 217*b* of extension shaft 206*b*.

Figure 7:
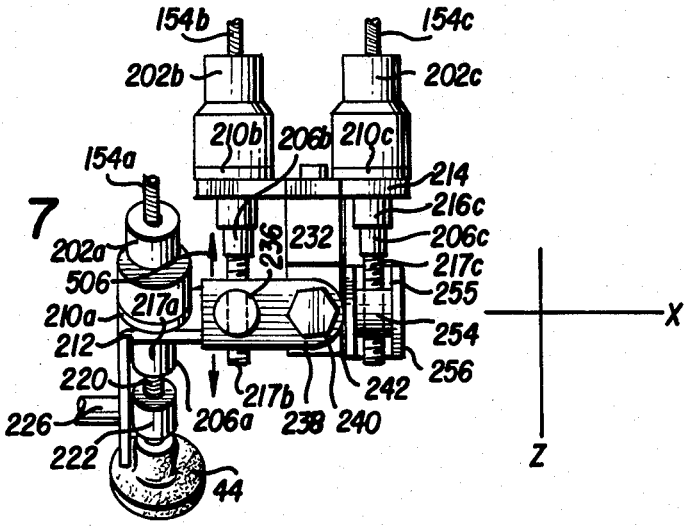
FIG. 7 is a bottom view of the adjusting means of FIG. 5.

Block member 232 has a rounded flange 238 protruding from a face of cube 230. Flange 238 has a hole extending therethrough of sufficient diameter to permit block member 232 to pivot about a pivot pin 240 passing through the flange hole. As shown in FIG. 7, the pivot pin 240 has an essentially hexagonal head at a first end and is securely anchored into a first mounting member 242 at its second end.

Member 242 would be essentially L-shaped except for the absence of a square portion at the intersection of its two arms 244 and 246 and the rounding of an extreme end of the arm 244. Arm 244 of first mounting member 242 has a hole 248 therethrough to accommodate a rotatable machine actuating shaft 48. The rotatable machine actuating shaft 48 passes through the hole 248 with sufficient clearance so that the rotary motion of the shaft 48 is essentially not transmitted to the first mounting member 242. In this regard, the actuating shaft 48 is a known element of prior art inserting machines or the like (such as that depicted in U.S. Pat. No. 3,325,455 to Williams, incorporated herein by reference) and has been used for moving sucker cups to and fro in the direction of arrow 46 (FIG. 2) with respect to a hopper.

A side of mounting member arm 246 has secured thereto the mounting bar 214 discussed earlier. The mounting bar 214 is secured to arm 246 by screws 252 which pass through a mid portion of the mounting bar 214 and into the arm 246 of mounting member 242. One end of the mounting bar 214 has an aperture therethrough to accommodate the extension shaft 206*b*; an opposite end of the mounting bar 214 has an aperture therethrough to accommodate extension shaft 206*c*.

With further reference to the adjusting means 200*c*, the threaded end portion 217*c* of extension shaft 206*c* is engaged by a counter-threaded pivot pin 254 which is rotatably mounted in a channel 255 of a clamping member 256. A top of clamp 256 has an aperture 258 extending therethrough to accommodate the machine actuating shaft 48. A slot 260 of adjustable width extends from the circumference of the aperture 258 in an essentially radial direction to an edge of the clamp 256. Tightening means, such as screw 262, extends through the clamp 256 transversely through the slot 260 for selectively varying the width of the slot 260, and thereby selectively tightening the grip of clamp 256 on the actuating shaft 48. Thus, unlike mounting member 242, the clamp 256 is adapted to rotate about shaft 48 as shaft 48 rotates.

FIGS. 11 through 17 illustrate a combination of adjusting means 300 according to another embodiment of the invention. The adjusting means combination 300 comprises adjusting means 300*a*, 300*b*, and 300*c*. As will be seen hereinafter, adjusting means 300*a* is ultimately connected to up-and-down adjustment control knob 164*a*; adjusting means 300*b* is ultimately connected to in-out adjustment control knob 164*b*; and, adjusting means 300*c* is ultimately connected to tilt adjustment control knob 164*c*.

The adjusting means 300*b* comprises an end block 302 having an essentially square outer face. Integral with the end block 302 at one corner thereof is a clamping flange 304. An extreme of the clamping flange 304 opposite its union with the end block 302 is rounded and contains a hole 306 extending therethrough. The hole 306 is of sufficient diameter to accommodate the machine actuating shaft 48 which passes therethrough. A slot 308 of adjustable width extends from the circumference of the hole 306 in an essentially radial direction therefrom to an edge of the clamping flange 304 near its juncture with the end block 302. Tightening means, such as screw 310 extends through the clamping flange 304 and transversely through the slot 308 for selectively varying the width of the slot 308, and thereby selectively tightening the grip of clamping flange 304 on the actuating shaft 48.

An inner face of end block 302 has four projections 312 formed thereon, one projection in each corner of the block 302. Additionally, an aperture extends transversely through end block 302 from its outer face to its inner face and accommodates a fastener 314 (see FIGS. 12 and 17).

After passing through the end block 302, the fastener 314 extends through a counter-threaded bore of a first end of a essentially rectangular housing 316. The housing 316 is comprised of two mating halves **316*a* and 316*b* which are secured together by four threaded fasteners 318. At their intersection the mating halves 316*a* and 316*b* of housing 316 have a threaded channel which, when the housing 316 is assembled, forms a counter-threaded bore 320 which accommodates the threaded fastener 314. Moreover, at its first end each corner of the housing 316 is fabricated to accommodate the projections 312 which protrude from end block 302**.

A second aperture extends through the housing 316 in a direction perpendicular to the counter-threaded bore 320. This second aperture, like bore 320, is formed by two mating channels fabricated in each mating half **316*a*, 316*b*, of the housing. The second aperture accommodates a rotatable shaft 322 which extends essentially through the housing 316. A cable end connector 327 is secured to an end of the shaft 322 by appropriate fasteners. Cable end connectors 327, as well as shaft 322, are adapted to rotate in the direction of arrow 329**.

Figure 17:
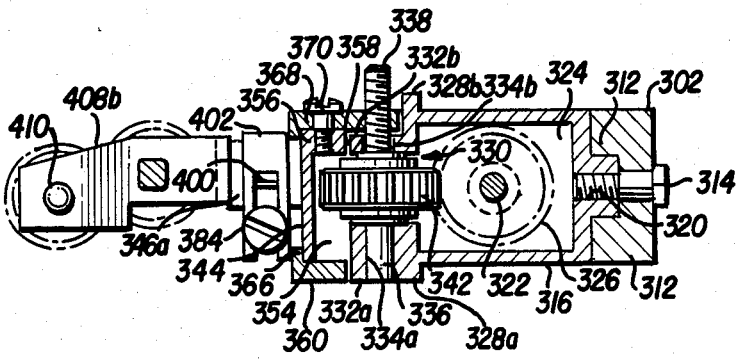
FIG. 17 is a sectional view of the adjusting means of FIG. 16 taken along the line 17—17.

As seen in FIG. 17, the housing mating halves **316*a*, 316*b* define a relatively hollow internal space 324. A circular toothed gear 326 is concentric with and secured to the shaft 322 so as to be substantially contained in the space 324 of housing 316**.

Each mating half **316*a*, 316*b* of housing 316 has at a second end thereof (opposite the end which receives end block 302) slightly protruding shoulder portions 328*a*, 328*b*, respectively. The end of housing 316 which includes shoulders 328*a*, 328*b* does not completely enclose the space 324 but permits an essentially rectangular opening 330** therein.

Integral with a side of shoulder **328*a* of housing 316 is a T-shaped bracket 332*a*. A smaller T-shaped bracket 332*b* is integral with a side of shoulder portion 328*b*. Each bracket 332*a* and 332*b* have apertures 334*a* and 334*b* respectively, extending therethrough. Apertures 334*a* and 334*b* are aligned and adapted to accommodate a rotatable shaft 336. Shaft 336 is threaded along a portion 338 where the shaft travels through and emerges from the side of T-shaped bracket 332*b*. In this respect, bracket 332*b* has a semi-cylindrical channel 340 fabricated therethrough. Should the T-shaped bracket 332*b* be viewed as standing upright, the U-shaped channel 340** would be seen to extend from the top (or horizontal portion) of the bracket and down through the base of the bracket (essentially vertical) where it forms an essentially semi-circular curve.

The rotatable shaft 336 has mounted on an intermediate portion thereof between the brackets **332*a* and 332*b* a circular gear 342 having teeth on its periphery. Gear 342 is concentric with the shaft 336 and is secured thereto for rotation with the shaft 336. A portion of the gear 342 extends through the opening 330 in housing 316 and extends into the space 324 defined by housing 316. Furthermore, gear 342 is adapted to mesh with the gear 326 which is contained in housing 316 and mounted upon shaft 322. In this respect, gear 342 is adapted to convert rotary motion about an axis comprising shaft 322 into rotary motion about an axis perpendicular thereto comprising shaft 336**.

Figure 12:
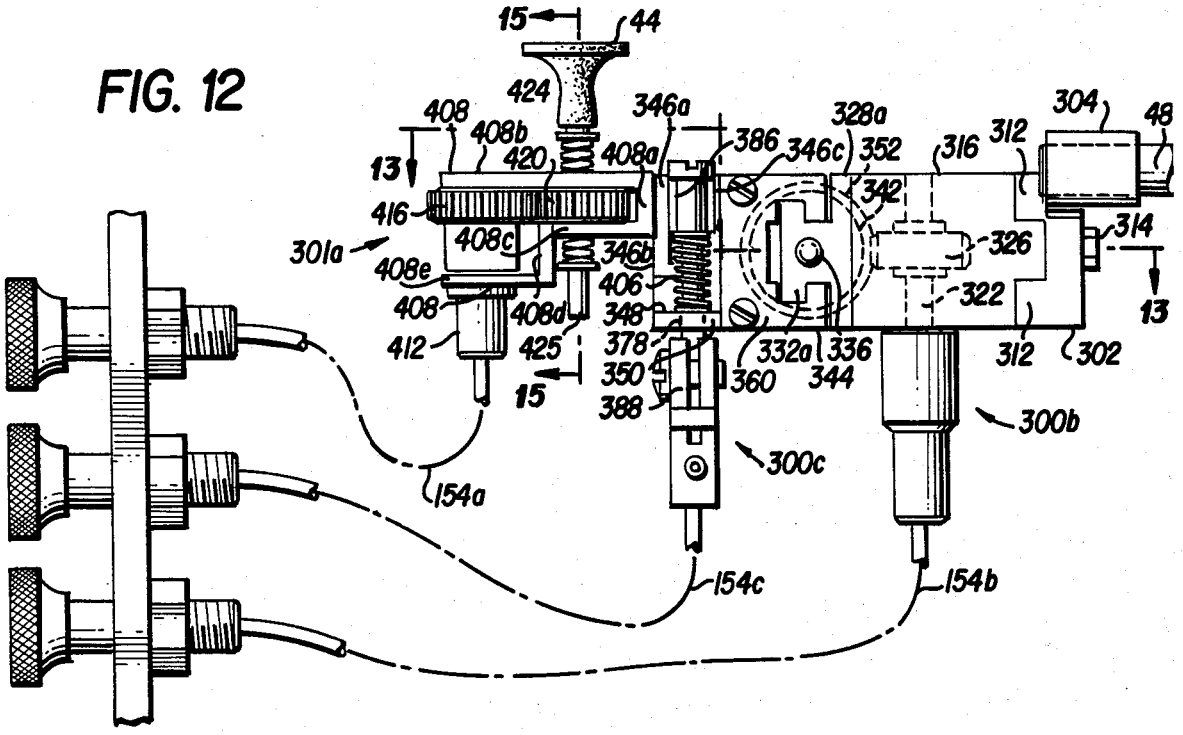
FIG. 12 is a side view of the adjusting means of FIG. 11.

The combination 300 of adjusting means further comprises a second housing 344 which is essentially rectangular in shape. As seen in FIG. 12, an essentially U-shaped bracket 346 having arms **346*a*, 346*c*, and a base 346*b* are integral with a portion of the housing 344. In this respect, the bracket 346 does not extend across the full width of the housing 344 but across only a portion thereof. Bracket base 346*b* has a semi-cylindrical channel 348 grooved therein which, as seen in FIG. 16, is bounded by a mounting flange 350 which extends substantially across the housing 344. Thus, as seen in FIG. 16, the channel 348** appears substantially j-shaped.

As seen in FIGS. 12 and 17, housing 344 has an essentially half-cylindrical opening 352 formed therein to form a space 354. One side of the housing 344 is essentially open to permit the bracket **332*a* to protrude therethrough. An opposite end of the housing 344 is partially closed with a wall 356 but has an opening 358 therein large enough to accommodate the T-shaped bracket 332*b*. The essentially semi-cylindrical space 354 in housing 344 is of sufficient size to accommodate the gear 342**.

An essentially C-shaped retaining member 360 is adapted to be secured to the side of housing (344 which heretofore was described as essentially open (See FIG. 11)). The retainer 360 is secured to the housing 344 by a fastening means 362 which extend through the retainer 360 and into the housing 344. An essentially central opening 364 in the C-shaped retainer 360 is adapted to accommodate the T-shaped bracket **332*a* with sufficient clearance to allow the bracket 332*a* to move tranversely therethrough. The C-shaped retainer 360 also has a flange 366 which fits over a portion of the housing 344**.

Figure 14:
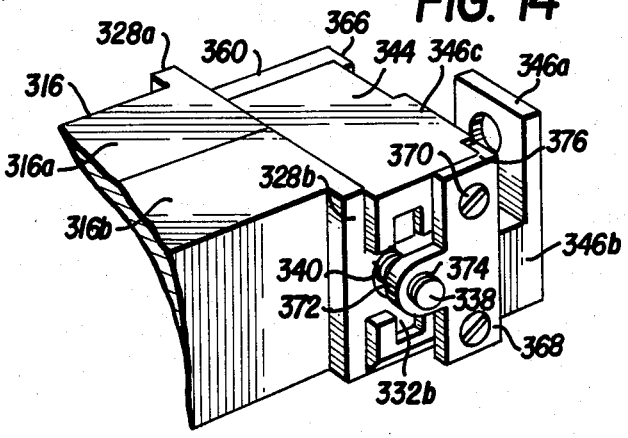
FIG. 14 is a perspective view of a portion of elements of the embodiment of FIG. 11.

Wall 356 of housing 344 also has on its outer side a retaining member 368 which is secured thereto by threaded fasteners, such as screws 370. As seen in FIG. 14, retainer 368 has a semi-circular protrusion 372 extending therefrom in the direction of housing 316. Protrusion 372 has a central counter-threaded bore 374 extending transversely therethrough adapted to engage the threaded portion 338 of shaft 336. Retainer 368 also has a flange 376 adapted to fit over a side of the housing 344.

The mounting flange 350 of housing 344 which is integral with bracket base **346*b* has a bore 378 extending transversely therethrough and adapted to engage a threaded portion 380 of a bolt 382 which rotates therein. The bolt 382 has a head 384 and a intermediate portion 386 as well as the threaded portion 380**.

Threaded portion 380 of bolt 382 extends from the mounting flange 350 and into a clamping member 388. Clamp 388 has a slot 390 of variable width and counter-threaded so that threaded portion 380 of bolt 382 extends longitudinally therethrough. Tightening means, such as screw 392 extends transversely through a threaded aperture in the clamp 388 for selectively varying the width of the slot 390.

Integral with clamp 388 is a connector 394. Connector 394 is essentially rectangular in shape and is adapted to receive in an internal channel portion the flexible cable 154*c*. In this respect, cable 154*c* is retained in the connector 394 by a threaded securing means 396. Clamp 388 and connector 394 are fabricated as one piece and are rotatable in the direction shown by arrow 398 in FIG. 11.

Bracket arms 346*a* and 346*c* have apertures extending transversely therethrough to accommodate a rotatable shaft 400 (See FIGS. 13 and 17). Mounted on a shaft 400 and between bracket arms 346*a* and 346*c* is U-shaped bracket having arms 402*a* and 402*c* oriented essentially perpendicular to the arms 346*a*, 346*c* of bracket 346. Since bracket 402 is mounted on rotatable shaft 400 by means of set screw 403 or the like, bracket 402 is adapted to rotate in the direction shown by arrow 404.

Intermediate portion 386 of bolt 382 passes between arms 402*a* and 402*c* of U-shaped bracket 402. Bracket arms 402*a* and 402*c* are separated by a distance which is smaller than the diameter of the head 384 of bolt 382 so that the arms 402*a*, 402*c* serve to retain head 384 at one side of the bracket 402. Biasing means, such as spring 406, is concentrically positioned over the intermediate portion 386 of bolt 382. In this respect, spring 406*b* has one end abutting the mounting flange 350 and an opposite end abutting bracket arms 402*a*, 402*c*.

Considering now adjustment means 300*a*, the rotatable shaft 400 is integral with a bracket generally designated 408. Bracket 408 has a base 408*a*; a first leg 408*b* which is essentially straight; and a second leg which is comprised of three segments 408*c*, 408*d*, and 408*e*. Bracket segment 408*c* is essentially parallel to bracket arm 408*b* and has a first end which joins bracket base 408*a*. Bracket segment 408*d* connects to a second end of bracket segment 408*c* but is essentially perpendicular to and extending away from bracket arm 408*b*. At its most remote end from bracket 408*b* the bracket segment 408*d* joins bracket segment 408*e* which is essentially parallel to bracket arm 408*b*. Hence, as seen in FIG. 12, the separation between bracket 408*b* and bracket segment 408*e* is greater than the separation between bracket arm 408*b* and bracket segment 408*c*.

Bracket arm 408*b* and bracket segment 408*e* each have an aperture extending transversely therethrough and correspondingly aligned to receive a rotatable shaft 410. Shaft 410 protrudes through bracket portion 408*e* so that it may be engaged by an end of a connector 412. Although not illustrated as such, it should be understood that fastening means, such as a set screw, secures the shaft 410 within the connector 412. Likewise, an opposite end of the connector 412 has secured in a socket thereof by appropriate fastening means the flexible cable 154*a*. Cable 154*a*, connector 412 and shaft 410 are adapted to rotate as depicted by arrow 414 in FIG. 11.

Figure 15:
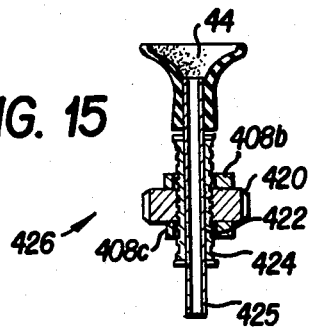
FIG. 15 is a sectional view of the adjusting means of FIG. 12 taken along the line 15—15.

Mounted on the rotatable shaft 410 and between bracket arm 408*b* and bracket segment 408*e* is a circular gear 416 having teeth 418 on a peripheral portion thereof. Teeth 418 of gear 416 are adapted to mesh with similar teeth on a neighboring circular gear 420. As seen in FIG. 15, gear 420 has a central bore 422 extending axially therethrough. Bore 422 is adapted to receive a square-threaded portion 424 of a stem 425. Stem 425 also passes through appropriately counter-threaded apertures in bracket arm 408*b* and bracket segment 408*c*. In this regard, gear 420 is sandwiched between bracket arm 408*b* and bracket segment 408*c*. A first end of stem 425 has a vacuum cup 44 secured thereto while a second end of stem 425 is connected to a suitable vacuum line (not illustrated).

To assist in the discussion of operation of the embodiment described above, views of mutually orthogonal axes X, Y, and Z have been included in FIGS. 3A, 5, 7, and 11.

In operation, when it is desired to adjust the position of insert breaker plate 32 to which supports the stack of documents 40, an operator simply manually rotates gear shaft control knob 86. Since control knob 86 is connected to gear shaft 84, the rotary motion of control knob 86 is imparted to the gear shaft 84. Likewise, as gear shaft 84 rotates, gear 96 at the bottom end thereof rotates in the same direction. As the teeth on gear 96 meshed with teeth on gear 98, gear 98 also rotates. In this respect, the interaction of gears 96 and 98 translate rotary motion in the essentially horizontal plane of gear 96 into rotary motion in the essentially vertical plane of gear 98. As gear 98 rotates, the flexible cable 112 having a first end connected to the gear 98 also rotates.

The rotary motion emparted to flexible cable 112 by gear 98 causes connector 118 at a second end of the flexible cable 112 to rotate as well. As the connector 118 rotates, the threaded adjusting screw 122 secured thereto also rotates. The interaction of threads on the adjusting screw 122 with counter-threaded bores 126 and 130 in screw block 128 and breaker plate block 132, respectively, cause the blocks 128 and 132 to translate along the longitudinal axis of the adjusting screw 122. Since both screw block 128 and breaker plate block 132 are secured to the underside of the insert breaker plate 32, the insert breaker plate 32 translates in a direction parallel to the longitudinal axis of the adjusting screw 122 as well. In this respect, as insert breaker plate 32 translates, head portion 34 thereof travels along floor side rails 28 and base portion 36 remains and travels above rail reportion 30 of the hopper floor 26. Thus, depending on the direction of rotation of the control knob 86, the insert breaker plate 32 translates in such a manner to adjust the size of the gap 38 between breaker plate 32 and front wall 24 of the hopper 20.

Figure 3:
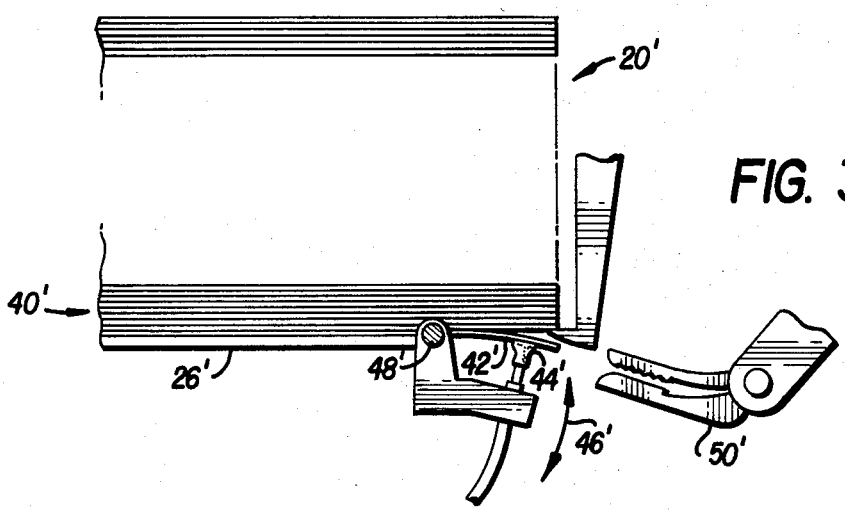
FIG. 3 is a sectional side view of a hopper and showing both a feeding means connected to a document handling machine in accordance with prior practice as well as a gripping means positioned proximate the hopper.
Figure 3A:
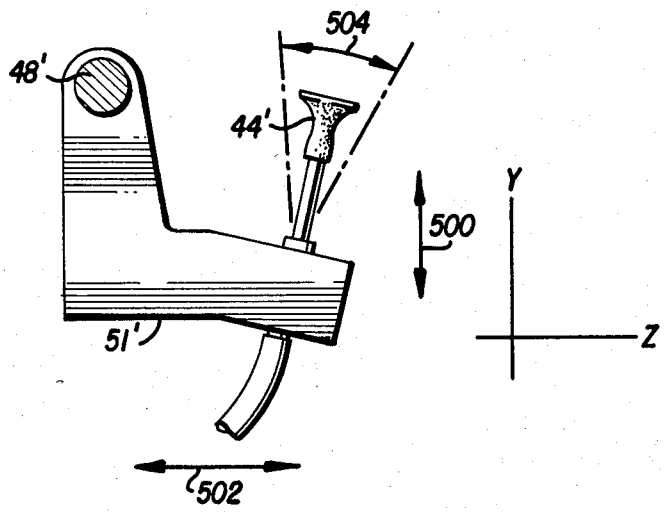
FIG. 3A is an isolated view of the prior art structure of FIG. 3.

With reference to the prior art apparatus of FIGS. 3 and 3*a*, it has already been observed that feeding means 44' is adapted to rotate in the direction of arrow 46' about the machine's actuating shaft 48'. In the prior art apparatus wherein a mere clamp 51' is used to connect the feeding means 44' to the machine actuating shaft 48', the sucker cup 44' invariably contacts each lowermost document 42' in the same position.

Desired placement of the sucker cup 44 with respect to the hopper 20 may vary, however, depending on various characteristics of documents in the hopper. Such characteristics include document size, moisture content, static, curl and grain as well as environmental humidity. Unfortunately, the prior art apparatus provide no means for remotely adjusting the position of the feeding means with respect to an up-down direction (denoted by arrow 500 in FIG. 3A): in an in-out direction (denoted by arrow 502 in FIG. 3A): and through an angular tilt (denoted by arrow 504 in FIG. 3A).

Figure 5:
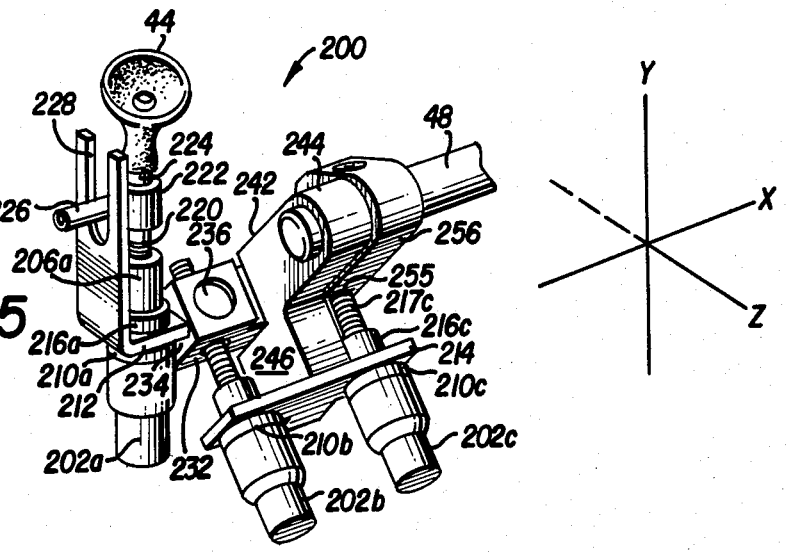
FIG. 5 is a perspective view of an embodiment of adjusting means.
Figure 6:
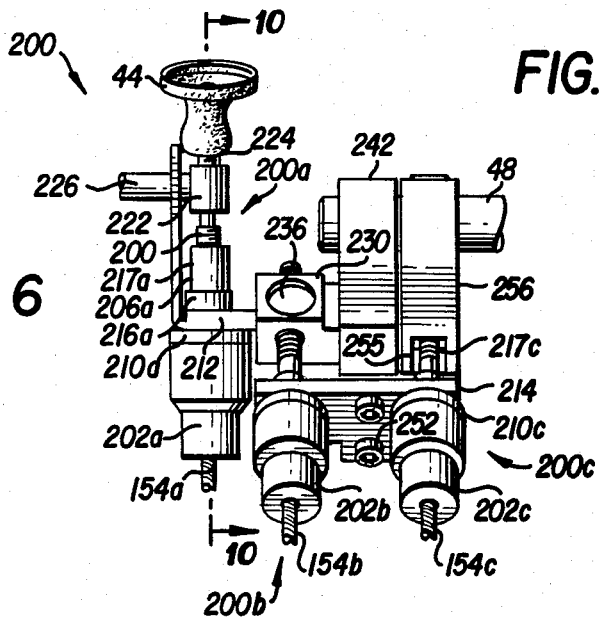
FIG. 6 is a rear view of the adjusting means of FIG. 5.

In order to adjust the position of the sucker cup 44 associated with the embodiment depicted in FIGS. 5 through 10 with respect to Y axis of FIG. 5 (that is, in the up-and-down direction), the operator need only rotate the up-and-down adjustment control knob 164*a* located upon control panel 52. Rotation of the control knob 164*a* causes the rotation of cylindrical member 163*a*, connector 156*a*, and the flexible cable 154*a* secured therein. The rotation of flexible cable 154*a* further causes the rotation of connector 202*a* and the cylindrical extension shaft 206*a*. Since cylindrical extension shaft 206*a* has a central bore 218 which is counterthreaded to engage the threaded stem 220 upon which sucker cup holder 222 is mounted, rotation of the extension shaft 206 causes the threaded stem 220, the sucker cup holder 222, and the sucker cup 44 to translate in the direction of the longitudinal axis of extension shaft 206*a*. Translation of the sucker cup 44 in the direction of the longitudinal axis of shaft 206*a* gives the sucker cup 44 a component of translation along the Y-axis of FIG. 5 as well, thus resulting in displacement in the up-and-down direction relative to the distance of the sucker cup 44 beneath the hopper 20.

In order to adjust the position of the sucker cup 44 associated with the embodiment depicted in FIGS. 5 through 10 with respect to the Z-axis of FIG. 5 (that is, in the in-out direction), the operator need only rotate the in-out control knob 164*b*. In the same manner as described with respect to up-and-down control knob 164*a* and flexible cable 154*a*, rotation of the control knob 164*b* causes the rotation of connector 202*b* and extension shaft 206*b*. Since threaded portion 217*b* of shaft 206*b* is threadingly engaged by the rotating pivot pin 236, rotation of shaft threaded portion 217*b* tends to cause pivot pin 236 to translate along the longitudinal axis of the extension shaft 206*b*. Since pivot pin 236 is rotatable within block member 232, and since block number 232 is adapted to pivot about pin 240, rotation of the shaft threaded portion 217*b* causes block member 232 and sucker cup 44 engaged thereto to rotate about the Y-axis shown in FIG. 5. The rotation of sucker cup 44 about the Y axis gives it a component of translation along the Z-axis of FIG. 5, thus resulting in displacement in the in-out direction.

In order to adjust the position of sucker cup 44 associated with the embodiment depicted in FIGS. 5 through 10 with respect to the X-axis of FIG. 5, (that is, in the tilt direction), the operator need only rotate the tilt adjustment control knob 164*c*. In a fashion analogous to the procedure already described, rotation of the tilt-adjustment control knob 164*c* results in the rotation of cable end connector 202*c* and extension shaft 206*c*. Since a threaded portion 217*c* of shaft 206*c* is engaged by a rotatable pivot pin 254, rotation of the threaded portion 217*c* tends to cause translation of the pivot pin 254 along the longitudinal axis of the extension sleeve 206*c*. However, since the pivot pin 254 is rotatable within clamp 256, and since clamp 256 is rigidly secured to machine actuating shaft 48, rotation of the shaft threaded portion 217*c* causes sleeve 206*c* and the sucker cup 44 ultimately connected thereto to rotate about the X-axis of FIG. 5, resulting in a tilt of the sucker cup 44 with respect to the bottom of the hopper 20.

In order to adjust the sucker cup 44 associated with the embodiment depicted in FIGS. 11 through 17 with respect to the Y-axis of FIG. 5, (that is, in the up-and-down direction), the operator need only rotate the up-and-down adjustment control knob 164*a*. As described with respect to the embodiment depicted in FIGS. 5 through 10, rotation of the control knob 164*a* results in rotation of the flexible cable 154*a* and, in this embodiment, the cable end connector 412. As connector 412 rotates, so does rotatable shaft 410 engaged thereby. Rotation of the shaft 410 causes gear 416 to rotate and to impart to neighboring gear 420 meshed therewith the rotary motion as well. As gear 420 rotates, the square-threaded portion 424 of stem 425 travels in the direction depicted by arrow 508 (essential in the direction of the longitudinal axis of stem 425). As the stem 425 translates, so does sucker cup 44 mounted thereon. Translation of the sucker cup 44 in the direction of the longitudinal axis of stem 425 gives the sucker cup 44 a component of translation along the Y-axis of FIG. 11, thus resulting in displacement in the up-and-down direction relative to the distance between the sucker cup 44 and the hopper 20.

In order to adjust the position of the sucker cup 44 associated with the embodiment depicted in FIGS. 11 through 17 with respect to the Z-axis of FIG. 11 (that is, and the in-out direction), the operator need only rotate the in-out adjustment control knob 164*b*. In a manner similar to that herein before described, rotation of the control knob 164*b* results in rotation of the end connector 327 and in rotation of shaft 322 engaged therewith. As shaft 322 rotates, so does gear 326 mounted thereon. Since gear 326 meshes with neighboring gear 342, and since the central axis of gear 342 is essentially perpendicular to the central axis of gear 326, gear 342 rotates in a plane essentially perpendicular to the plane of gear 326.

As gear 342 rotates, so does rotatable shaft 336 secured through the center of gear 342. Since retainer 368 has a counter-threaded bore 374 therein to engage threaded end portion 338 of rotatable shaft 336, and since retainer 368 is secured to the housing 344, housing 344 translates in a direction parallel to the longitudinal axis of the rotatable shaft 336 as shaft 336 rotates.

As evident from the structural description above, sucker cup 44 is connected to the housing 344 by a structure including bracket 346 and bracket 408. Hence, as the housing 344 translates with respect to the housing 316 along the Z-axis as seen in FIG. 11, sucker cup 44 translates along the Z-axis as well. Translation of the sucker cup along the Z-axis results in a displacement in the in-out direction.

In order to adjust the position of the sucker cup 44 associated with the embodiment depicted in FIGS. 11 through 17 with respect to the X-axis of FIG. 11 (that is, the angular tilt direction), the operator need only rotate the tilt adjustment control knob 164*c*. As in the manner discussed hereinbefore, rotation of the control knob 164*c* causes rotation of the flexible cable 164*c*, which in turn causes rotation of the connector 394 and clamp 388 integral therewith. Rotation of the clamp 388 causes similar rotation of the bolt 382 engaged by the clamp 388. Rotation of the threaded portion 380 of bolt 382 in counter-threaded bore 378 of mounting flange 350 causes the bolt 382 to translate along its longitudinal axis.

When bolt 382 translates in a direction toward the mounting flange 350, the bolt head 384 engaging bracket arms 402*a* and 402*c* causes bracket 402 mounted on rotating shaft 400 to pivot toward mounting flange 350 in the direction shown by arrow 404.

When bolt 382 translates in a direction away from the mounting flange 350, spring 406 pushes against the bracket arms 402*a* and 402*c* and causes the bracket 402 to pivot away from flange 350 in the direction of arrow 404.

In the above regard, when the bolt 382 is translating in either direction, translation of the bolt 382 causes the bracket 402 to rotate about the X axis in the direction of arrow 404. Rotation of the bracket 402 causes rotation of the shaft 400. When the shaft 400 rotates, bracket 408 integral therewith rotates as well, as does sucker cup 44 mounted to bracket 408 in the manner described above. Thus, sucker cup 44 rotates about the X axis of FIG. 11, resulting in a tilt of the sucker cup 44 with respect to the X axis.

It should be understood that rotation of any of the adjustment control arms 86, 164*a*, 164*b*, or 164*c* may be accomplished while the document handling machine is in operation. Thus the relative position of the insert breaker plate 32 and the sucker cup 44 may be quickly adjusted without interrupting operation of the document handling machine.

While the invention has been particularly shown and described with reference to the preferred embodiments thereof it will be understood by those skilled in the art that various alterations in form and detail may be made therein without departing from the spirit and scope of the invention. For example, control knobs such as those illustrated in FIG. 12 may be used instead of the control knobs discussed with reference to FIGS. 2 and 4.

The embodiments of the invention in which exclusive property or privilege is claimed are defined as follows:

1. Apparatus for adjusting a feeding means associated with a hopper of a document handling machine, said feeding means comprising a sucker cup mounted on a rotatable threaded stem; said sucker cup communicating through a channel in said threaded stem to a vacuum line, said apparatus comprising:

adjusting means for adjusting said feeding means with respect to an axis thereof, said means for adjusting said feeding means further comprising:

connector means;

first gear means attached to said connector means; and, second gear means adapted to cooperate with said first gear means, said second gear means further being adapted to rotate and to convert said rotary motion into translation of said feeding means along said axis, said second gear means having a central, counter-threaded bore adapted to receive said threaded stem, whereby said stem translates along said axis as said second gear rotates;

elongated flexible cable means having one end thereof attached to said connector means of said adjusting means and the other end thereof affixed to a remote location on said document feeding machine; and, means at the remote end of said elongated flexible cable means for selectively moving said elongated flexible cable means by an amount corresponding to the desired motion of said adjusting means with respect to said axis thereof, whereby said feeding means can be adjusted from said remote location.

2. Apparatus for adjusting a feeding means associated with a hopper of a document handling machine, said apparatus comprising:

adjusting means for adjusting said feeding means with respect to an axis thereof, said adjusting means comprising:

connector means;

rotatable shaft means having a first end affixed to said connector means and adapted to rotate with said connector means, said rotatable shaft having a threaded region along at least an intermediate portion thereof and a second end with an enlarged head;

mounting means ultimately connected to said document handling machine, said mounting means being counter-threaded and adapted to receive said threaded region of said rotatable shaft means;

shaft engagement means rotatably mounted to said mounting means, said shaft engagement means contacting said intermediate portion of said shaft means near said enlarged head thereof, said shaft engagement means being ultimately connected to said feeding means; and, biasing means connected intermediate said shaft engagement means and a portion of said mounting means, whereby as said shaft means rotates said biasing means causes said shaft engagement means to rotate about said axis;

elongated flexible cable means having one end thereof attached to said connector means of said adjusting means and the other end thereof affixed to a remote location on said document feeding machine; and;

means at the remote end of said elongated flexible cable means for selectively moving said elongated flexible cable means by an amount corresponding to the desired motion of said adjusting means with respect to said axis thereof, whereby said feeding means can be adjusted from said remote location.

3. Apparatus of claim 2, wherein said biasing means includes a spring.

4. Apparatus for adjusting a feeding means associated with a hopper of a document handling machine, said apparatus comprising:

adjusting means for adjusting said feeding means with respect to an axis thereof, said adjusting means comprising:

connector means;

rotatable shaft means engaged by said connector means;

first housing means mounted to said document handling machine and having said rotatable shaft means extending therein;

second housing means connected to said first housing means, said second housing means having said feeding means ultimately connected thereto; and, means for causing said second housing means to translate with respect to said axis and said first housing means as said rotatable shaft rotates;

elongated flexible cable means having one end thereof attached to said connector means of said adjusting means and the other end thereof affixed to a remote location on said document feeding machine; and, means at the remote end of said elongated flexible cable means for selectively moving said elongated flexible cable means by an amount corresponding to the desired motion of said adjusting means with respect to said axis thereof, whereby said feeding means can be adjusted from said remote location.

5. Apparatus of claim 4, wherein said means for adjusting said feeding means further comprises:

first gearing means connected to said rotatable shaft means and adapted for rotational motion, at least a portion of said first gearing means being housed in said first housing means;

second gearing means adapted to cooperate with said first gearing means, said second gearing means adapted for rotational motion in a plane essentially perpendicular to a plane wherein said first gearing means rotates;

second rotating shaft means, said second rotating shaft means having said second gearing means affixed to an intermediate portion thereof, said second rotating shaft means also being threaded at each end thereof, each end of said second rotating shaft means being received in a counter-threaded bore in said second housing, so that as said second gearing means rotates, said second housing translates with respect to said axis.

6. Apparatus for adjusting a feeding means associated with a hopper of a document handling machine comprising:

first means for adjusting said feeding means along a first axis;

second means for adjusting said feeding means along a second axis;

third means for adjusting said feeding means for rotation about a third axis;

connecting means for connecting each of said means for adjusting said feeding means to a location remote from said feeding means; and, means at said remote location for selectively moving said connecting means to cause selective adjustments of each of said means for adjusting said feeding means.

7. Apparatus of claim 6 wherein said connecting means comprise elongated flexible cables associated with each of said first, second, and third adjusting means.

8. Apparatus of claim 7 wherein said means at the remote end of each of said elongated flexible cables is operative to rotate the respective elongated flexible cable; and, wherein said first and second adjusting means include means to convert the rotary motion of said elongated flexible cable into translation of said feeding means along said first and second axes; and, wherein, said third adjusting means includes means to convert the rotary motion of the associated elongated flexible cable into rotation of said feeding means about said third axis.

9. Apparatus of claim 7, wherein said first means for adjusting said feeding means further comprises:

first connector means, said connector means having one end of said flexible cable attached thereto;

first gear means attached to said connector means;

second gear means adapted to cooperate with said first gear means of said second gear means further being adapted to rotate and to convert said rotary motion into translation of said feeding means along said first axis.

10. Apparatus of claim 9, wherein said feeding means comprises a sucker cup mounted on a rotatable threaded stem portion, wherein said vacuum cup communicates through a channel in said stem portion to a vacuum line; and wherein said second gear means has a central, counter-threaded bore adapted to receive said threaded stem portion, wherein said stem portion translates along said first axis as said second gear rotates.

11. Apparatus of claim 7, wherein said second means for adjusting said feeding means further comprises:

second connector means, said connector means having one end of said flexible cable attached thereto;

rotatable shaft means engaged by said connector means;

first housing means mounted to said document handline machine and having said rotatable shaft means extending therein;

second housing means connected to said first housing means, said second housing means having said feeding means ultimately connected thereto; and, means for causing said second housing means to translate with respect to said second axis and said first housing means as said rotatable shaft rotates.

12. Apparatus of claim 11, wherein said second means for adjusting said feeding means further comprises:

first gearing means connected to said rotatable shaft means and adapted for rotational motion of at least a portion of said first gearing means being housed in said first housing means;

second gearing means adapted to cooperate with said first gearing means, said second gearing means adapted for rotational motion in a plane essentially perpendicular to a plane wherein said first gearing means rotates;

second rotating shaft means, said second rotating shaft means having said second gearing means affixed to an intermediate portion thereof, said second rotating shaft means also being threaded at each end thereof, each end of said second rotating shaft means being received in a counter-threaded bore in said second housing, so that as said second gearing means rotates, said second housing translates with respect to said third axis.

13. Apparatus of claim 7, wherein said third means for adjusting said feeding means further comprises:

third connector means, said connector means having one end of said flexible cable attached thereto;

rotatable shaft means having a first end affixed to said connector means and adapted to rotate with said connector means, said rotatable shaft having a region threaded in at least an intermediate portion and a second end with an enlarged head;

mounting means ultimately connected to said document handling machine, said mounting means being counter-threaded and adapted to receive said threaded region of said rotatable shaft means;

shaft engagement means rotatably mounted to said mounting means, said shaft engagement means contacting said intermediate portion of said shaft means near said enlarged head thereof, said shaft engagement means being ultimately connected to said feeding means;

biasing means connected intermediate said shaft engagement means and said mounting means, whereby as said shaft means rotates said biasing means causes said shaft engagement means to rotate about said axis.

14. Apparatus of claim 9, wherein said housing means includes a spring.

* * * * *